United States Patent [19]

Gold et al.

[11] Patent Number: 5,038,077

[45] Date of Patent: Aug. 6, 1991

[54] GYROKLYSTRON DEVICE HAVING MULTI-SLOT BUNCHING CAVITIES

[75] Inventors: Steven H. Gold, New Carrollton, Md.; Arne W. Fliflet, Alexandria, Va.

[73] Assignee: The United States of American as represented by the Secretary of the Navy, Washington, D.C.

[21] Appl. No.: 304,442

[22] Filed: Jan. 31, 1989

[51] Int. Cl.[5] ..... H01J 25/14

[52] U.S. Cl. ..... 315/5.39; 315/5.51; 331/83; 331/91

[58] Field of Search ..... 315/4, 5, 5.14, 5.16, 315/5.29, 5.39, 5.49, 5.51; 330/45; 331/81, 83, 91; 333/228

[56] References Cited

U.S. PATENT DOCUMENTS

| | | | |
|---|---|---|---|
| 2,547,061 | 4/1951 | Touraton et al. | 315/5.51 X |
| 3,453,483 | 7/1969 | Leidigh | 315/5.51 X |
| 3,509,412 | 4/1970 | Demmel | 333/228 X |
| 4,395,655 | 7/1983 | Wurthman | 315/4 |
| 4,398,121 | 8/1983 | Chodorow et al. | 315/4 |
| 4,897,609 | 1/1990 | Mallavarpu | 315/4 X |

FOREIGN PATENT DOCUMENTS 82769 6/1983 European Pat. Off. .

OTHER PUBLICATIONS

*Publication*, "Boundary Integral Method for Computing Eigenfunctions in Slotted Gyrotron Cavities of Arbitrary Cross-Sections", by S. W. McDonald et al., Int. J. Electronics, 1986, vol. 61, No. 6, 795-822.

*Publication*, Optimization of Gyroklystron Efficiency, by T. M. Tran et al., Phys. Fluids, vol. 29, No. 4, Apr. 1986.

*Primary Examiner*—Eugene R. LaRoche
*Assistant Examiner*—Benny T. Lee
*Attorney, Agent, or Firm*—Thomas E. McDonnell; Peter T. Rutkowski; Lawrence A. Root

[57] ABSTRACT

A gyroklystron device includes an electron beam source, a plurality of bunching cavities and an output cavity. A first bunching cavity has an input coupling aperture for receiving an rf signal from an rf signal injecting source. Each of the bunching cavities has a first pair of substantially uniform-angle slots of a preselected angle, which are diametrically opposed, and extend axially, parallel to the direction of the electron beam and extend into drift regions on both sides of the cavities. The first pair of slots control the Q of a desired mode and higher order modes. A second and third pair of slots are diametrically opposed and extend axially, parallel to the direction of the first pair of slots, but are rotated 90 degrees circumferentially from the first pair of slots. These slots control the axial profile of any mode that leaks out beyond the desired mode and control the length of field interaction with the electron beam. The second and third pair of slots begin in the walls of drift regions just beyond the first pair of slots, and have a preselected angle at their beginning and the angle increases in size along an axial distance away from the cavities. An outer vacuum jacket lined with rf absorbing material is also included such that rf energy leaving through the slots will not return.

6 Claims, 3 Drawing Sheets

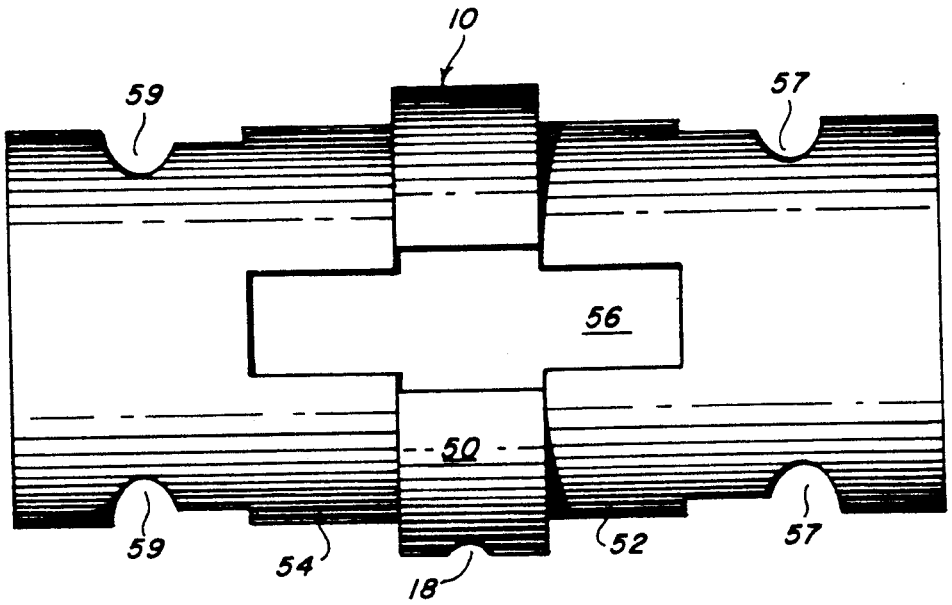
FIG. 2
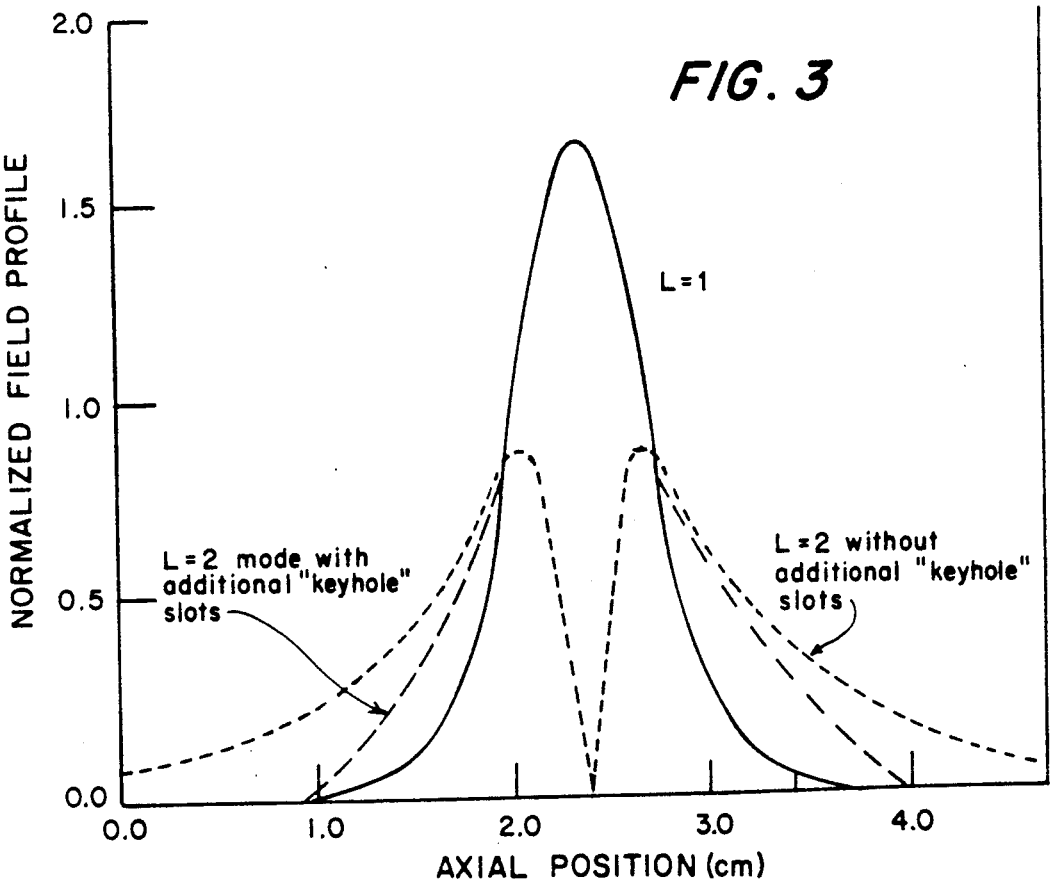

GYROKLYSTRON DEVICE HAVING MULTI-SLOT BUNCHING CAVITIES

BACKGROUND OF THE INVENTION

1. Field Of The Invention

This invention relates to innovations in the design of bunching (also called prebunching) cavities for high power gyroklystron amplifiers or phase-locked gyroklystron oscillators, and more particularly to the arrangement of slots in the walls of the bunching cavities as well as in the cut-off regions.

2. Background Description

A gyroklystron is a cyclotron maser device operating in the gyrotron mode (i.e., either near cutoff in a microwave cavity, or with $k_z$ of the mode near zero) that employs one or more bunching cavities, separated by drift spaces that are cutoff to the modes of the bunching cavities, and followed by an output cavity. As such, it operates in a strong axial magnetic field, such that the operating frequency is near the cyclotron frequency or one of its harmonics. An external signal is applied to the first of the bunching cavities, and used to initiate a phase-modulation of the beam. This modulation is magnified by transit through the drift spaces (much as in a conventional klystron the axial velocity modulation leads to axial bunching). The output cavity acts either as an amplifier of the external signal, in which case the device is called a gyroklystron amplifier, or alternatively, the output cavity will produce power, i.e. oscillate, without an external signal, in which case one can attempt to phase lock and frequency lock this oscillation and the device is called a phase-locked gyroklystron oscillator.

There are a number of design constraints with respect to the bunching cavities of a gyroklystron amplifier or phase-locked gyroklystron oscillator. Specifically, there are two pairs of conflicting constraints that a design must satisfy. The first pair of conflicting constraints are that the cavity (or cavities) must be stable against self-oscillation both in the desired mode, e.g. the fundamental, cylindrical $TE_{111}$mode, as well as in competing axial and transverse modes, in the first and higher harmonics of the cyclotron maser interaction, while simultaneously sustaining large drive fields from an external source in order to produce the bunching of the electron beam that permits amplifier or phase-locked oscillator operation. The second pair of conflicting constraints are that the bunching cavity or cavities must be isolated from each other and from the output cavity, so that information will not flow back from the output cavity to the bunching cavities, causing the system to self-oscillate or oscillate without phase control, while at the same time the diameter of the drift spaces must permit transit of the electron beam that drives the interaction. This constraint becomes more difficult to achieve at higher frequencies, e.g. 35 GHz and above, due to the necessity that the transverse dimension of the drift space be below cutoff to the operating mode. For instance, if the operating mode is the fundamental rectangular mode, the transverse dimension of the drift space would be less than or on the order of ½ of the free-space wavelength of the mode. If the operating mode is the fundamental cylindrical mode, the transverse dimension of the drift space would be less than or on the order of .586 of the free-space wavelength of the mode. Furthermore, precise tuning of the bunching cavity with respect to the output cavity is essential, so that the ability to mechanically tune the cavity in order to obtain this precise tuning without remachining of the cavity is very valuable.

Previous phase-locked gyroklystron oscillator bunching cavities have faced the same design constraints, and the cavity designs employed had severe limitations. Cavity loading was accomplished by means of resistive walls, which are very inflexible in determining ultimate cavity Q-factors. Furthermore, the previous method did not provide control of competing transverse modes by preferentially lowering their Q-values. It also did not provide a means to control the length of the interaction both in the lowest order axial mode (the preferred mode) and in higher order axial modes, thus increasing the danger of self-oscillation in these modes, which would prevent successful gyroklystron operation. The disadvantages of the old approach apply particularly to devices designed to operate at millimeter-wave and higher frequencies, where the device cross sections decrease, making the twin requirements of beam propagation and cavity cutoff difficult to simultaneously satisfy.

The foregoing illustrates limitations known to exist in present devices. Thus, it is apparent that it would be advantageous to provide an alternative directed to overcoming one or more of the limitations set forth above. A suitable alternative is provided including features more fully disclosed hereinafter.

SUMMARY OF THE INVENTION

Accordingly, it is a general object of the present invention to successfully operate a gyroklystron device at millimeter-wave and higher frequencies while simultaneously satisfying the twin requirements of cavity cutoff and beam propagation.

It is another object of the present invention to provide a gyroklystron having a means to control the length of interaction between an electron beam and an injected field, both in the lowest order axial mode and higher order axial modes thus preventing self-oscillation in these modes.

It is a more specific object of the present invention to provide a gyroklystron having a bunching cavity which is designed to control competing transverse modes by preferentially lowering the Q-values associated with these modes.

It is a further object of the present invention to provide a gyroklystron having a bunching cavity which is designed to allow for precise tuning of the cavity.

The foregoing is accomplished by a gyroklystron device which includes an electron beam source, a plurality of bunching cavities and an output cavity, and a means for injecting an RF signal into a first bunching cavity. The first bunching cavity has an input coupling aperture for receiving the signal from the RF injecting means. Each of the cavities has a first pair of slots, diametrically opposed and extending axially, parallel to the direction of the electron beam and extending into the drift regions on both sides of said cavities to a distance equal to the extent of the field of a desired mode of said cavities. A second and third pair of slots are diametrically opposed and extend axially, parallel to the direction of the first pair of slots, but are rotated 90 degrees radially from the first pair of slots, wherein each pair of slots begin in the walls of the drift regions just beyond said first pair of slots, and wherein the second and third pair of slots have a preselected angle at their beginning and said angle grows larger as the axial distance from the cavity increases so as not to interfere with the mode profile of the fundamental mode. An outer vacuum jacket around the cavities is lined with RF absorbing material such that RF energy leaving through a slot will not return.

Thus, the invention is directed to a novel arrangement of slots in the RF circuit of a gyroklystron device, which satisfies the twin requirements of having a bunching cavity which is stable against self-oscillation both in the desired mode as well as in competing axial and transverse modes, in the first and higher harmonics of cyclotron maser interaction, while simultaneously sustaining large drive fields from an external source in order to produce the bunching of the electron beam that permits amplifier or phase-locked oscillator operation; and also permitting transit of the electron beam, that drives the interaction, through the drift space. The first pair of slots provide for linear polarization, control of the Q of the desired mode and higher order modes, and tuneability of the cavities. The second and third pair of slots control the axial profile of any mode that leaks out beyond the desired mode, and control the length of field interaction with the electron beam, and load the Q of drift regions for modes of any polarization.

BRIEF DESCRIPTION OF THE DRAWINGS

A more complete appreciation of the invention will be readily obtained by reference to the following Description of The Preferred Embodiment and the accompanying drawings wherein:

FIG. 2 is a plan view of a prebunching cavity and adjacent drift regions;

FIG. 3 is a graphical representation of the normalized field profiles associated with the prebunching cavity design of FIG. 2;

DESCRIPTION OF THE PREFERRED EMBODIMENT

Figure 1:
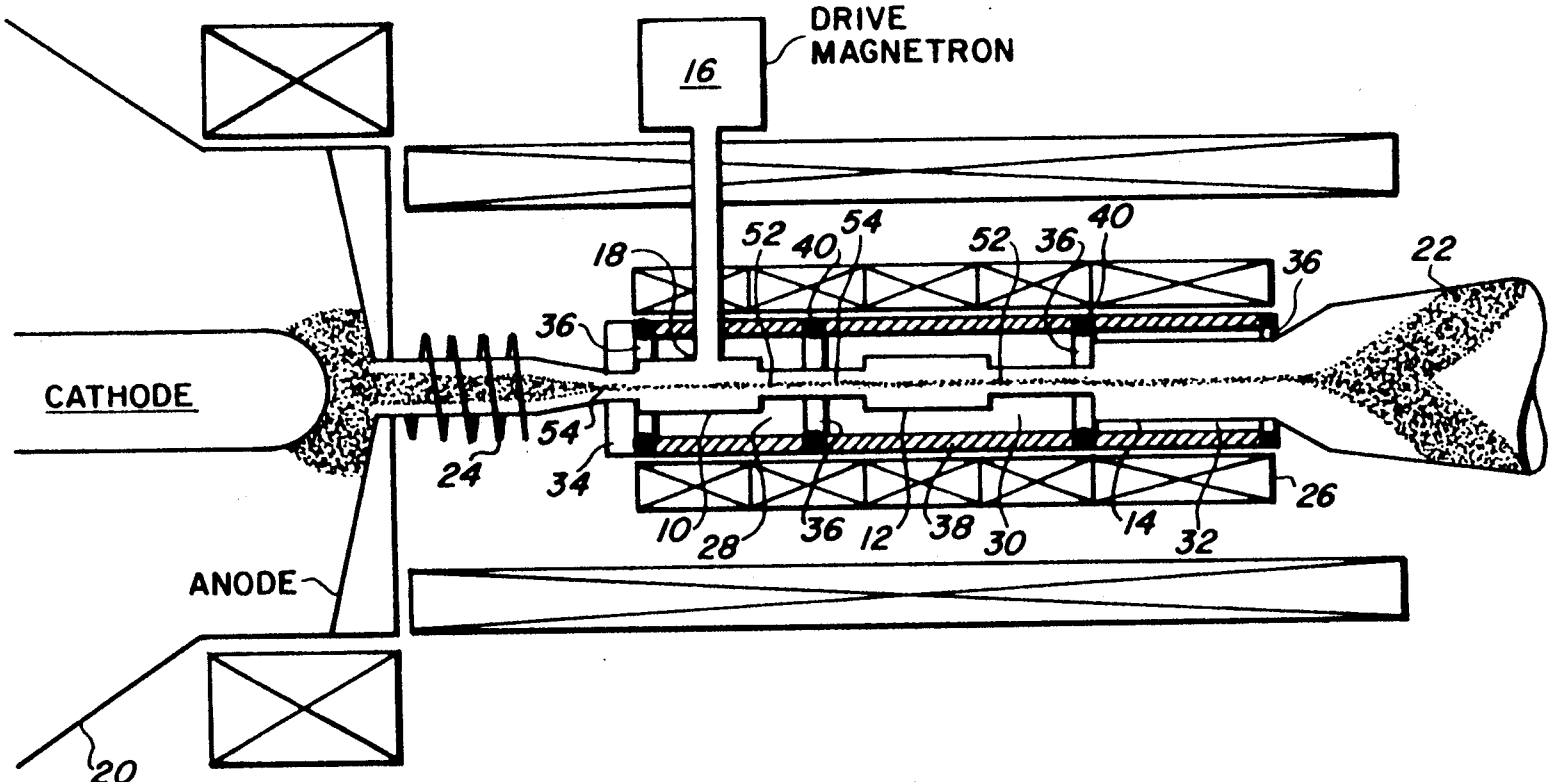
FIG. 1 is a schematic diagram of a three-cavity phase-locked gyrotron oscillator.

A schematic of the overall gyroklystron configuration is shown in FIG. 1. Shown are the bunching cavities 10 and 12, drift regions 52 and 54, the output cavity 14, the drive magnetron 16 used to inject RF signal into the first bunching cavity 10 through an input coupling aperture 18, a electron beam generator 20 used to produce an electron beam 22, a bifilar helix wiggler magnet 24 used to generate transverse momentum on the electron beam 22, and pulsed solenoids 26 used to provide the needed magnetic field for the gyrotron interaction. Cavities 10, 12, and 14 are fabricated of a conductive material such as copper or stainless steel. The gyroklystron device also includes separate vacuum regions 28, 30 and 32 which surround bunching cavities 10, 12 and output cavity 14 respectively. The Vacuum regions 28, 30, and 32 are formed by fitting a vacuum jacket 34 over the cavities and drift regions 52, 54 between the cavities, and by separating the vacuum regions 28, 30, and 32 from each other by partitions 36 which may be made from stainless steel. Vacuum jacket 34 also has an RF absorbing layer 38 around its interior surface such that RF energy leaving slots (to be described in conjunction with FIGS. 2, 4 and 5 in the cavity and drift region walls will be absorbed and will not return. RF gaskets 40 are also provided to prevent RF energy from leaking between the different vacuum regions 28, 30 and 32.

A novel prebunching cavity has been produced to meet the design constraints outlined in the Background of The Invention, by a novel arrangement of slots (described below) in the walls of bunching cavities 10, 12 (the above cutoff region of the RF circuit that leads to the output cavity) as well as in the cutoff regions.

In the preferred embodiment, the bunching cavities are designed to operate in the fundamental $TE_{111}$cylindrical cavity mode. The use of this mode simplifies the problems of spurious mode excitation and cavity cross-talk which can occur when the bunching cavities are designed to operate in a higher order mode. Some competition from the $TE_{112}$higher order axial mode could not be avoided due to the constraint on the minimum drift tube diameter set by the requirement to propagate the electron beam. As shown in FIG. 1 there are one or more bunching cavities 10, 12 separated by drift regions 52, 54 and leading to an output cavity 14. There is provision in the first of the bunching cavities to inject an external RF signal through a coupling aperture 18 in the cavity wall. An electron beam enters the cavity region from one side and exits from the other side. The properties of the electron beam 22 must be appropriate for a gyroklystron device: i.e., a substantial fraction of the total beam momentum must be transverse to the applied magnetic field and electron beam 22 must have a small axial velocity spread. The exit beam tube functions as a drift space to enhance the phase-modulation of electron beam 22. Subsequent cavities can enhance the phase-modulation of electron beam 22. The entire RF circuit is immersed in a strong axial magnetic field, with the cyclotron frequency associated with this magnetic field (or possibly a harmonic of the cyclotron frequency) close to the operating frequency of the device.

As described in the Background of the Invention, the bunching cavity or cavities 10, 12 must be short and have low Q to prevent spontaneous oscillation of the cavity due to the presence of electron beam 22. The field in subsequent bunching cavities must be due to oscillation caused by the beam bunching generated in previous bunching cavities, and not due to self-oscillation. The important requirement is therefore to prevent self-oscillation both in the desired $TE_{111}$mode and in all possible competing modes in the first and higher harmonics of the cyclotron maser interaction. This is achieved by control of the Q-factor of the cavity for the various modes, since start oscillation threshold is inversely proportional to Q factor, and by control of the axial profile of the RF field of each mode, since longer interaction lengths will reduce the start oscillation thresholds.(The higher the start-oscillation threshold is raised, the more beam current can be employed in the device, the more transverse momentum the beam can have, and the more flexibility there will be in selecting the operating magnetic field--all these factors generally will permit higher power operation.) In addition, it is important to achieve these requirements and at the same time have the capability to generate substantial fields in the first bunching cavity 10 due to an external drive signal applied to one or more coupling apertures 18, since the drive signal is used to produce either amplification or phase-locking. Furthermore, the beam drift regions 52, 54 must be large enough to allow transit of the electron beam through the device, while simultaneously the various cavities must be isolated sufficiently to prevent feedback oscillation.

Figure 5:
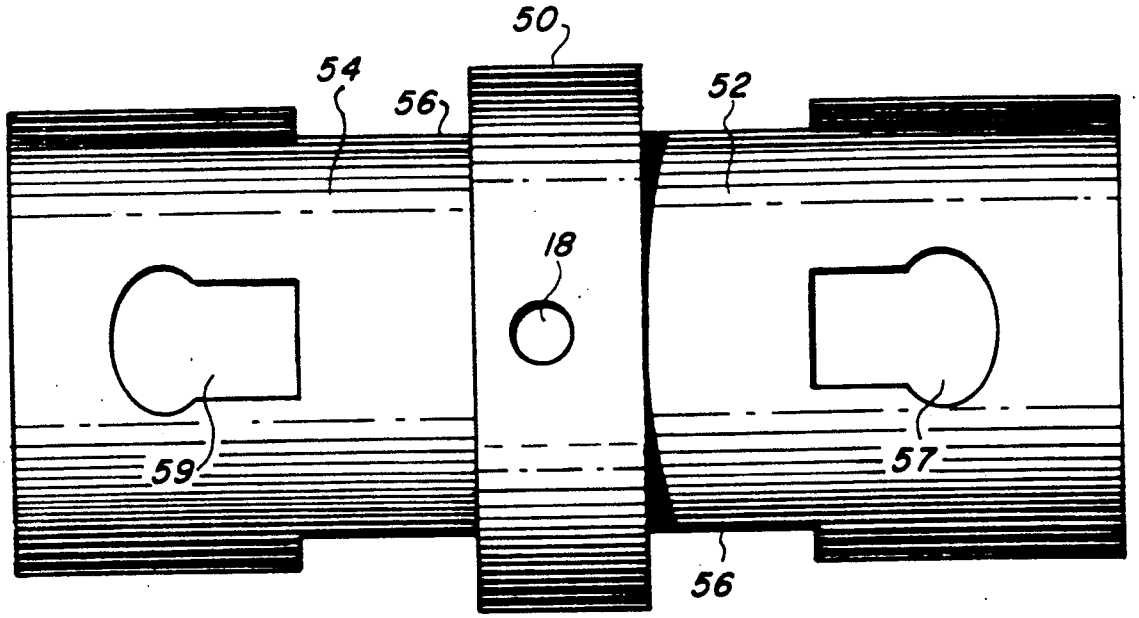
FIG. 5 is a side view of the prebunching cavity of FIG. 2 and adjacent drift regions.

These various constraints are satisfied by the slot configuration shown schematically in FIGS. 2 and 5. A plan and side view of a new bunching cavity configuration, and the resultant axial field profiles in the $TE_{111}$ and $TE_{112}$ modes, is given in FIGS. 2 and 3 respectively. The cavity is a short above cut-off region 50 with connecting beam pipes 52 and 54 that are below cutoff to the desired $TE_{111}$ mode. A pair of orthogonal slots 56, placed opposite to each other around the circumference of the cavity wall 10 or 12, extend the entire length of cavity 10 or 12 and extend into drift regions 52 or 54 respectively, to completely suppress one linear polarization of the desired $TE_{111}$ mode, while allowing complete control of the Q-factor of the orthogonal "preferred" linear polarization. This is possible because the slots will strongly suppress one linear polarization of the modes (i.e., the linear polarization with electric fields orthogonal to the slot plane), while controllably loading the Q of the preferred linear polarization i.e., the linear polarization with electric fields along the slot plane. It is preferred that the slots be of a uniform angle along their axial extent and that cavity slot angle $\theta$ be sufficient to generate an appropriate Q so as to prevent self oscillation within the cavity.

Figure 4:
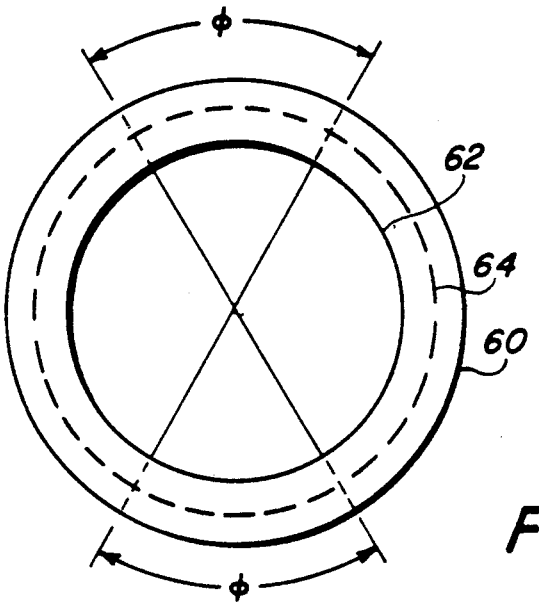
FIG. 4 is an end view of the prebunching cavity of FIG. 2.

FIG. 4 is an end view of bunching cavities 10, 12 and drift tubes 52 and 54 as shown in FIG. 2. The bunching cavity inner diameter 64 can be seen between the drift tube inner diameter 62 and outer diameter 60. The angle $\theta$ is the angle defined by two radial lines that originate from the center of cavity 10 or 12 and extend radially outward to the respective outer edges or boundaries of slots 56. A method to determine the slot angle $\theta$, necessary in a generic RF cavity to produce a particular effect on the Q-factor for a particular mode was published by S. McDonald, J. M. Finn, and W. M. Manheimer, in "Boundary Integral Method For Computing Eigenfunctions In Slotted Gyrotron Cavities Of Arbitrary Cross-sections", *Int. J. Electron.* vol. 61, pp. 795–822, 1986, and said article is herein incorporated by reference.

The final Q-factor is also determined by the effect of the coupling aperture used to bring the drive signal into the gyroklystron bunching cavity. However, if this aperture 18 is large enough to dominate the Q factor of the cavity, it will lead to the undesirable condition of over-coupling of the drive signal to the cavity, resulting in poor coupling of the drive power into the cavity i.e. there will be substantial power reflection back to the source of the drive signal. Furthermore, a large coupling aperture 18 will only load certain modes, and thus is not as effective as the slot configuration described herein.

In the preferred embodiment, a total Q of 200 was desired, and this was to be achieved by having an external Q (i.,e., the Q associated with the coupling aperture) of 400, combined with an internal Q (i.,e., the Q associated with all other cavity losses) of 400. The Q that is desired is that which will allow for proper gyroklystron operation with cavities stable against self-oscillation. A method of selecting the appropriate Q is described in "Design Of A High Voltage Multi-Cavity 35 GHz Phase-Locked Gyrotron Oscillator" *NRL Memo Report* 6065; *National Technical Information Service. ADA* 200350 (Nov. 1, 1988) by A. W. Fliflet et al., which publication is herein incorporated by reference. A 44° full slot angle was calculated to produce this desired Q in the preferred embodiment. This slots 56 also substantially further lowers the Q of all competing modes, since the slot losses for these other modes are much larger than that for the $TE_{111}$ mode. In order to ensure that the $TE_{111}$ coupling aperture 18 would also substantially load the $TE_{112}$ mode, the coupling aperture 18 was placed one-third of the distance from an end of the cavity, rather than at the cavity midplane, as shown in FIG. 2.

For a cavity which is only weakly cutoff at its ends (due to requirements of beam transport through the device), there will be substantial leakage of RF fields out of the above-cutoff region of the RF circuit into the below-cutoff drift space. This both raises the Q of the cavity modes, which lowers the start oscillation threshold current proportionally, but also lengthens the interaction region of the gyrotron electron beam and the RF cavity mode, thus greatly lowering the start oscillation threshold current. This will restrict ultimate device operation to very low power levels, since the low currents necessary to avoid oscillation will restrict the power level of the device. In order to overcome this difficulty, two further innovations in cavity design are used.

First, since there is substantial RF field leakage as an evanescent mode in the cutoff region, it is necessary to extend the slot 56 into this region as well. If we call the length of the above cutoff region of the cavity L, slots 56 extend a distance L on each side of the above cutoff regions in order to uniformly load the $TE_{111}$ mode throughout its axial extent. The higher order $TE_{112}$ mode is more weakly cutoff in drift regions 52, 54, since its frequency is higher. It would therefore have a much lower start oscillation current, greatly restricting the usable beam current. In order to suppress the Q of this mode, and also to limit its axial extent, additional pairs of slots 57 and 59, of non-constant axial extent, are placed in the drift regions 52, 54 beginning just beyond the main cavity slots, but rotated 90° from them. These slots 57 and 59 are narrower at the ends nearest the cavities, in order not to load down the tail of the $TE_{111}$ mode excessively, and open up into large apertures (diameters approximately equal to the cutoff section diameter) at the ends farthest from the cavities, to very effectively suppress modes polarized along the plane of the main cavity slots, i.e. to suppress the $TE_{112}$ mode in the preferred embodiment. Such slots strongly load modes with substantial RF fields in these regions that are in the preferred polarization of the above-cutoff cavity region. Thus the starting location of these additional slots 57 and 59, effectively determines the end point of the axial profile function of the RF mode. All the slots 56 in FIG. 2 and slots 57 and 59 in FIG. 5 connect to an outer enclosure 28 or 30 lined with RF absorbing layer 38 such that RF energy leaving through a slot will not return. The main slots 56 do not significantly affect the axial profile function of the cavity modes, since they are uniform in angle everywhere that the mode has significant RF fields. This is most true for the $TE_{111}$ mode, and only approximately true for the $TE_{112}$ mode, that leaks further into the below cutoff or drift regions 52 and 54. However, the second and third pairs of slots 57 and 59 have a significant effect on the axial profile function of the $TE_{112}$ mode, since they suppress it only in the regions of the below cutoff region over which they extend.

In addition, the combination of pairs of opposing axial slots, oriented at 90° to each other in different regions of the drift space also greatly lower the Q of the cutoff section itself, when viewed as a cavity, by strongly loading all possible polarizations of the drift regions 52, 54. This precludes spurious oscillations in the drift region 52, 54.

Referring to FIG. 3, the affect of the various slots on the fundamental $TE_{111}$and $TE_{112}$modes is shown. The horizontal axis of the graph represents the horizontal position of the normalized field profile along the structure shown in FIG. 2. It can be seen that for the $TE_{11}$-2mode, without the additional "keyhole" slots, there is substantial field leakage into the drift regions 52 and 54. However, with the addition of the second and third pair of "keyhole" slots 57 and 59 rotated 90° from the main slots 56, the axial field profile is modified and the interaction length with the electron beam 22 is reduced.

The various slots 56, 57 and 59 also permit "squash" tuning of the cavity frequency. Squash tunability uses a change in volume of a cavity to effect the particular frequency to which the cavity is tuned. This can be accomplished by applying an external compressive force to the cavity in a plane perpendicular to the slot plane. Initially, the cavity is designed such that the frequency is on the low side of the desired frequency. When the cavity is squeezed, its frequency goes up.

In the first embodiment of the gyroklystron device, the electron beam 22 was generated by a 1 MV pulseline accelerator, and the reference signal was provided by a 35 GHz, 20 kW magnetron. The output power is in the range of 1-10 MW.

ALTERNATE EMBODIMENTS

This arrangement of wide slots combined with orthogonal slots in the drift spaces is not restricted to the $TE_{11}$mode bunching cavities, and could be applied to devices employing higher order transverse modes. If the bunching cavities were run in higher order modes, the Q of those modes could still be controlled with the slot arrangement of the present invention. However, other modes may create problems. Some modes are affected more than others by the slots. If there is only one mode to worry about, the Q of that mode can alwaYs be controlled by use of the slots. If there are a lot of modes to worry about, in a higher-order cavity, one mode may be suppressed while another mode will not. For example, the $TE_{13}$mode has been demonstrated to work well in the slotted cavity design of the invention.

This invention is not restricted to cylindrically symmetric cavities and could be incorporated in devices using rectangular or elliptical or other arbitrary cross sections.

The same design principles incorporating wide slots and orthogonal slots might have application in controlling the Q factor and the axial profile function in RF cavities intended for other purposes.

The innovations provided by this invention are intended to permit the design and fabrication of a very high peak power phase-locked gyrotron oscillator with maximum locking bandwidth. Such oscillators are of interest as sources for advanced high-accelerating-gradient RF accelerators and as sources for phased-array directed-energy antenna systems. The invention incorporates important new elements in the design of the RF circuit of such a device. The control of the axial extent of weakly cutoff modes using orthogonal slots is an important new feature of this invention.

The foregoing has described a novel arrangement of slots in the RF circuit of a gyroklystron device which satisfies the requirements of having a prebunching cavity which is stable against self-oscillation both in the desired mode as well as in competing axial and transverse modes, in the first and higher harmonics of the cyclotron maser interaction, while simultaneously sustaining large drive fields from an external source in order to produce the bunching of electron beam 22 that permits amplifier or phase-locked oscillator operation; and also permitting transit of the electron beam 22 that drives the interaction, through the drift region 52, 54. This is accomplished by having a first pair of uniform angle slots 56 extending axially along the bunching cavities 10, 12, on opposite sides of the bunching cavity and extending into the drift regions as far as there is substantial field in the desired mode. A second and third pair of opposing slats 57, 59 respectively are positioned in the walls of the drift regions, 90° from the first pair of slots. These slots are of a non-uniform angle and begin approximately where the first pair of slots 56 end. The angle of these slots becomes larger as the axial distance from the cavity increases. The second and third pair of slots provide for control of the axial profile of any mode that leaks out beyond the fundamental mode, and control the length of the field interaction.

Obviously, many modifications and variations of the present invention are possible in light of the above teachings. It is therefore understood that within the scope of the appended claims the invention may be practiced otherwise than as specifically described.

WHAT IS CLAIMED AS NEW AND IS DESIRED TO BE SECURED BY LETTERS PATENT IN THE UNITED STATES IS:

1. A gyroklystron device that controls the axial profile and the extent of the field of competing modes, said gyroklystron comprising:

an output cavity;

at least one bunching cavity; and at least one bunching cavity having an input coupling aperture capable of receiving an RF signal;

means for injecting said RF signal into said at least one bunching cavity via said input coupling aperture;

drift regions; said output cavity and said at least one bunching cavity isolated by said drift regions along a common axis;

vacuum sustaining means around said at least one bunching cavity, said drift regions, and said output cavity;

means for producing an electron beam that transits said cavities and said drift regions, said producing means including a source of electrons, a first magnetic means to impart transverse momentum to the electrons, and a second magnetic means to provide the needed magnetic field for successful gyroklystron operation; said at least one bunching cavity, said coupling aperture, and said means for producing configured so as to allow said RF signal and said electron beam to interact for successful gyroklystron operation;

said at least one bunching cavity including an outer wall having a first pair of slots, said slots being diametrically opposed and extending, parallel to said axis, into said drift regions a distance equal to the extent of the field of a desired mode of that cavity, said first pair of slots providing linear polarization, controlling the Q of the desired and higher order modes, and providing squash tunability of said at least one bunching cavity;

each said drift region including an outer wall having a second and third pairs of slots, all said slots having edges, said second and third pairs of slots being diametrically opposed and extending parallel to said first pair of slots, but located at a position about said axis 90 degrees from said first pair of slots, each of said second and third pairs of slots having an end located in said drift regions just beyond said first pair of slots; said second and third pair of slots extending axially into said drift regions to an extent sufficient to control the axial profile of any mode that leaks out beyond the desired mode; and said second and third pairs of slots configured so as to control the length of field interaction with the electron beam and load the Q of said drift region for modes of any polarization;

means disposed within said vacuum sustaining means for absorbing RF energy leaving through said slots such that said RF energy will not return through said slots.

2. The gyroklystron device of claim 1, wherein said first pair of slots form a preselected and substantially uniform angle defined by two radial lines originating from said common axis and extending radially to the respective edges of said first pair of slots.

3. The gyroklystron device of claim 2, wherein said second and third pair of slots each form a preselected angle at the end thereof but form a larger, preselected angle further away from the closest juncture with said at least one bunching cavity so as to suppress the undesired modes without interfering with the mode profiles of the desired mode.

4. The gyroklystron device of claim 3 wherein said at least one bunching cavity comprises a plurality of bunching cavities and wherein said means for injecting injects said RF signal into a first one of said plurality of bunching cavities.

5. A gyroklystron device that controls the axial profile and the extent of the field of competing modes, said gyroklystron comprising:

an output cavity;

at least one bunching cavity; said at least one bunching cavity having an input coupling aperture capable of receiving an RF signal;

means for injecting said RF signal into said at least one bunching cavity via said input coupling aperture;

drift regions; said output cavity and said at least one bunching cavity isolated by said drift regions along a common axis;

vacuum sustaining means around said at least one bunching cavity, said drift regions, and said output cavity;

means for producing an electron beam that transits said cavities and said drift regions, said producing means including a source of electrons, a first magnetic means to impart transverse momentum to the electrons, and a second magnetic means to provide the needed magnetic field for successful gyroklystron operation; said at least one bunching cavity, said coupling aperture, and said means for producing configured so as to allow said RF signal and said electron beam to interact for successful gyroklystron operation;

said at least one bunching cavity including an outer wall having a first pair of substantially uniform-angle slots of a pre-selected angle defined by two radial lines originating from said common axis; said slots being diametrically opposed and extending, parallel to said common axis into said drift regions a distance equal to the extent of the field of a desired mode of said cavity; said first pair of slots providing linear polarization, controlling the Q of fundamental and higher order modes, and providing squash tunability of said at least one bunching cavity;

each said drift region including an outer wall having a second and third pairs of slots, all said slots having edges; said second and third pairs of slots being diametrically opposed and extending parallel to the direction of said first pair of slots, but located at a position about said axis 90 degrees from said first pair of slots; each of said second and third pairs of slots having an end in said drift regions just beyond said first pair of slots; said second and third pair of slots each form a preselected angle at said end thereof but form a larger, preselected angle further away from the closest juncture with said at least one bunching cavity so as suppress the undesired modes without interfering with the mode profiles of the desired mode; said second and third pair of slots extending axially into said drift regions to an extent sufficient to control the axial profile of any mode that leaks out beyond the desired mode; said second and third pairs of slots configured so as to control the length of field interaction with the electron beam and to load the Q of said drift region for modes of any polarization;

means disposed within said vacuum sustaining means for absorbing RF energy leaving through said slots, such that said RF energy will not return through said slots.

6. The gyroklystron device of claim 5 wherein said at least one bunching cavity comprises a plurality of bunching cavities and wherein said means for injecting injects said RF signal into a first one of said plurality of bunching cavities.

* * * * *